US006390733B1

(12) United States Patent
Burbage et al.

(10) Patent No.: US 6,390,733 B1
(45) Date of Patent: May 21, 2002

(54) SIMPLIFIED STORAGE BARGE AND METHOD OF OPERATION

(75) Inventors: Peter John Burbage, Rue hector Otto; Robert Pucnik, Monaco Cedex, both of (MC)

(73) Assignee: Imodco, Inc., Houston, TX (US)

( * ) Notice: Subject to any disclaimer, the term of this patent is extended or adjusted under 35 U.S.C. 154(b) by 0 days.

(21) Appl. No.: 09/595,613

(22) Filed: Jun. 16, 2000

Related U.S. Application Data

(60) Provisional application No. 60/142,236, filed on Jul. 2, 1999.

(51) Int. Cl.[7] ..... B63B 25/08

(52) U.S. Cl. ..... 405/203; 114/74 R; 114/121

(58) Field of Search ..... 114/74 R, 256, 114/121, 124; 405/203

(56) References Cited

U.S. PATENT DOCUMENTS

| | | | | |
|---|---|---|---|---|
| 3,335,690 A | * | 8/1967 | Busking | 114/230 |
| 3,399,645 A | * | 9/1968 | Jurisich | 114/65 R |
| 3,525,312 A | * | 8/1970 | Beck | 114/256 |
| 3,554,152 A | * | 1/1971 | Campbell et al. | 114/125 |
| 3,602,302 A | * | 8/1971 | Kluth | 166/336 |
| 3,704,678 A | * | 12/1972 | Kelly | 114/16 R |
| 3,766,875 A | * | 10/1973 | Baki | 114/73 |
| 4,030,438 A | * | 6/1977 | Telfer | 114/74 R |
| 4,241,683 A | * | 12/1980 | Conway | 114/74 R |
| 5,492,075 A | | 2/1996 | Lerstad et al. | |

FOREIGN PATENT DOCUMENTS

| | | |
|---|---|---|
| GB | 2276353 A | 9/1994 |
| JP | 61147919 | 1/1988 |
| WO | WO 98/30437 | 7/1998 |

* cited by examiner

*Primary Examiner*—David Bagnell
*Assistant Examiner*—Katherine Mitchell
(74) *Attorney, Agent, or Firm*—Leon D. Rosen

(57) ABSTRACT

A barge (14) that stores liquid hydrocarbon (oil) from a producing facility (12) and offloads it perhaps once a month to a shuttle taker (40), is constructed for unmanned operation except during the once-per-month unloading. The barge has a permanent nonadjustable ballast (53, 54, 55) and has a solar powered system for communication with a central center for normal operation and emergency shutdown. The barge avoids a "hotel system" for a permanent crew (up to 50 people) by avoiding seawater ballast tanks, ballast pumps and related systems. The only person-operated equipment is an engine-generator set (142) and pumps (44), to be operated only during offloading for perhaps 3 days every month. The barge is unpowered except by solar energy or batteries, and is left unmanned except during offloading, so only temporary crew quarters are provided. The barge has a tank assembly (57) with rows of tanks connected in series so oil can be loaded and unloaded from the frontmost tank in each row. The barge is ballasted so the bottom walls (130) of the tanks extend at a slight downward-forward tilt so the last amount of stored oil can flow downhill to the frontmost tank for offloading onto the shuttle tanker.

7 Claims, 4 Drawing Sheets

SIMPLIFIED STORAGE BARGE AND METHOD OF OPERATION

CROSS-REFERENCE

Applicant claims priority from provisional patent application No. 60/142,236 filed Jul. 2, 1999.

BACKGROUND OF THE INVENTION

A common hydrocarbon production system includes a production facility with seafloor wells, and a pipeline connecting the production facility to a storage barge that can store a large quantity of liquid hydrocarbons, or oil, such as 40 days of production. At intervals such as every month, an offloading tanker or shuttle tanker removes oil from the storage barge and carries it to an onshore processing facility. It requires perhaps one to three days to transfer the stored oil to the offloading tanker. It may be noted that the production facility may include a platform, spar, TLP (tension lag platform), etc. to enable initial drilling of wells and maintenance and workover of existing wells.

A crew is commonly left on the storage barge at all times. The permanent crew members operate cargo and ballast pumps, provide maintenance and monitor proper operation of equipment on the barge. A seawater ballast system operated by the crew, compensates for changes in weight distribution during loading and unloading to assure barge stability at all times and assure that the strength limits of the vessel are not exceeded. The cost of the permanent crew of perhaps 50 people is substantial and it would be desirable if the barge could operate without them.

SUMMARY OF THE INVENTION

In accordance with one embodiment of the present invention, a storage barge is provided for receiving a constant flow of hydrocarbons from an offshore production facility and storing the liquid hydrocarbons, or oil, and for occasionally offloading the oil onto a tanker, where the barge is constructed so it can operate without a permanent crew. Instead, a crew boards the barge only during offloading, which occurs about once a month and lasts perhaps one to three days. The barge has a plurality of rows of tanks, each row extending along the length of the barge, with the tanks in a row being connected in series. Where oil from each row is removed by pumping from one end of the barge such as the bow end, there will be a slow flow of the last amounts of oil to the frontmost or bow tank. To facilitate such flow, the permanent ballast causes the barge to assume an orientation wherein bottom walls of the tanks in a row are angled between 0.5° and 8° from the horizontal so oil flows downhill towards the frontmost tank when the tanks are almost empty.

The barge is designed to not have a permanent crew onboard, but to have only a small temporary crew during offloading. This is accomplished by eliminating powered systems such as a seawater ballast system and conventional hydrocarbon-fueled power center, and using automatic and remote controlled systems to perform functions with power obtained from solar cells and batteries. The barge has a permanent unpowered ballast system, which eliminates a major prior need for permanent crew members.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
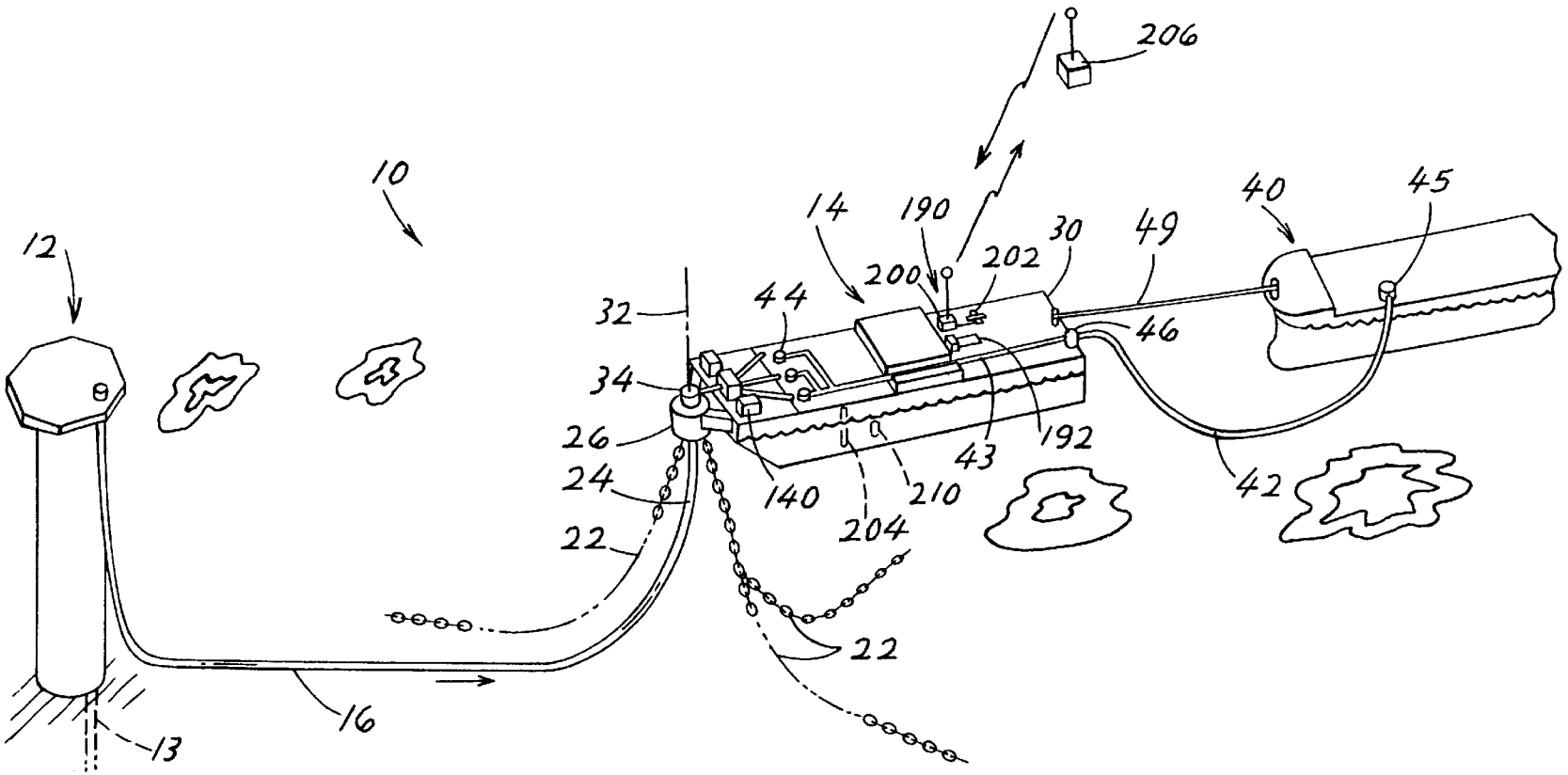
FIG. 1 is an isometric view of a hydrocarbon production system, with an offloading tanker connected to the barge.

FIG. 1 shows a hydrocarbon production and transfer system 10 which includes a facility 12 for producing hydrocarbons from undersea wells 13, such as a platform, Spar, TLP, etc.. The system also includes a storage barge 14 that is connected to the production facility 12, as by a pipeline 16 that extends from the facility 12 and along the sea floor 20 up to the barge 14 (possibly through a subsea buoy), or via a mid-depth flowline. The barge 14 is permanently anchored (although it might be removed perhaps every few years) at the general location of the facility, by anchor chains 22 that extend in different compass directions to the sea floor and along the sea floor. Other anchor facilities such as a single anchor chain, a rigid member extended towards the sea floor, can be used. The chains and the barge end 24 of the pipeline, extend to a turret 26 that allows the hull 30 of the barge to weathervane about the vertical axis 32 of the turret. That is, as winds, waves, and currents change, the barge hull 30 can pivot about the axis 32 to any position about it, as well as drift. The turret is preferably beyond the bow end of the hull, but instead can lie in a moonpool. An alternate is a spread moored barge.

The turret 26 carries a fluid swivel 34 (or at least the non-rotating part), with an inlet port connected to the pipeline 16 and with an outlet port coupled to storage tanks in the barge hull. In some cases the well effluent is fully processed at the production facility 12, as to remove almost all debris (e.g. sand) and separate out all liquid hydrocarbon (oil) from gas. However, such processing is not provided at this unmanned barge.

The barge can hold perhaps 40 days production from the facility 12. At intervals such as every 30 days (possibly more if a storm is present in the vicinity) a shuttle tanker 40 moves close to the storage barge 14. The tanker has a connection 45 that connects to a transfer line 42 extending to a coupling 46 on the storage barge. The coupling 46 is connected through a rigid pipe 43 that extends to pumps 44 at the bow of the storage barge, so hydrocarbons stored in the barge can be transferred to the tanker. Additional hydrocarbons can be pumped directly out of more rearward tanks for faster offloading. It requires perhaps 24 to 72 hours to transfer 30 days of production to the tanker. The tanker can be moored to the barge by mooring line 49.

Prior barges of this type generally have a permanent crew on the storage barge. The permanent crew quarters include at least 400 $ft^2$ (40 $m^2$) per crewman, including toilet, storage for food, etc. and food preparation facilities. The crewmen adjusted ballasting as the barge filled with hydrocarbons, notified a central station in the event of damages and repaired minor damage, and performed operations during offloading including connecting pipes, adjusting ballast as oil was offloaded, etc. The present invention is directed to a storage barge that avoids the need for a crew to stay on the barge during the long periods while it is being filled, which minimizes crew requirements during offloading, and which minimizes maintenance. The temporary crew quarters are less than 400 $ft^2$ (40 $meters^2$) per crewman, and usually less than 200 $ft^2$ (20 $m^2$). Usually, ten temporary crew members are used for each offloading, during a maximum of 3 days, so little living space is required. The temporary crewmen can make any repairs, while a control system with monitoring equipment can alert a central station of any major leaks and remotely operated valves can shut off valves when necessary.

The barge is provided with an intelligent and autonomous working control system 190 in FIG. 1 which monitors, controls and looks after the barge in the unmanned loading situation, and which is remotely controlled via telemetry by onshore people or people on another platform, vessel or barge. It is energized by a solar powered system on the barge that includes solar cells and batteries 192. The function of the control system is to monitor the loading of the barge and assure proper barge trim, and draft, and bending moments within safe limits. It manages the loading and safety procedures during the unmanned period and sends the information via a telemetric link to a manned control station 206. It also assures that the barge remains safe in case the telemetry link to the manned control point is lost, and it can assure an emergency shut down whenever it is necessary. The control system can, whenever needed, close certain valves in the unmanned loading mode. The control system has 100% redundancy; therefore there are dual systems on the barge, like a double valve system for fluid connections between the tanks. The control system receives information from various sensors, sends necessary alarms to the manned control station, sends necessary information to the manned station for operational and safety decisions, computes parameters for safety and operational decisions, and functions autonomously when cut off from outside communication. The control system thereby assumes the role of crew members.

Figure 8:
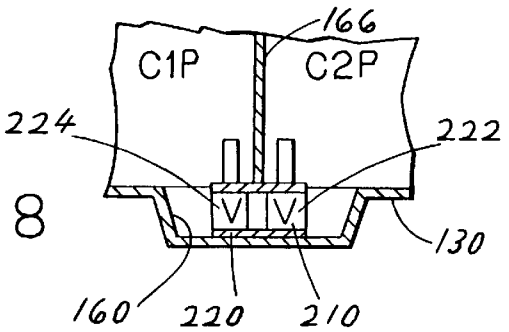
FIG. 8 is a partial sectional side view showing one fluid connection between adjacent tanks of a row of tanks of the barge of FIG. 7.

FIG. 1 shows a radio transceiver 200 on the barge, that is connected to sensors such as tilt sensors 202 that sense the pitch and roll of the barge, fill sensors 204 that sense how much hydrocarbons are in each tank, fire sensors, etc. The transceiver sends this information to the central station 206 located more than a kilometer away, and usually tens or hundreds of kilometers distant, on shore or on a platform. The transceiver receives radio signals (from a broadcast station, satellite, etc.) from the remote station, to operate equipment such as shut-off valves 210 (FIG. 8).

Figure 2:
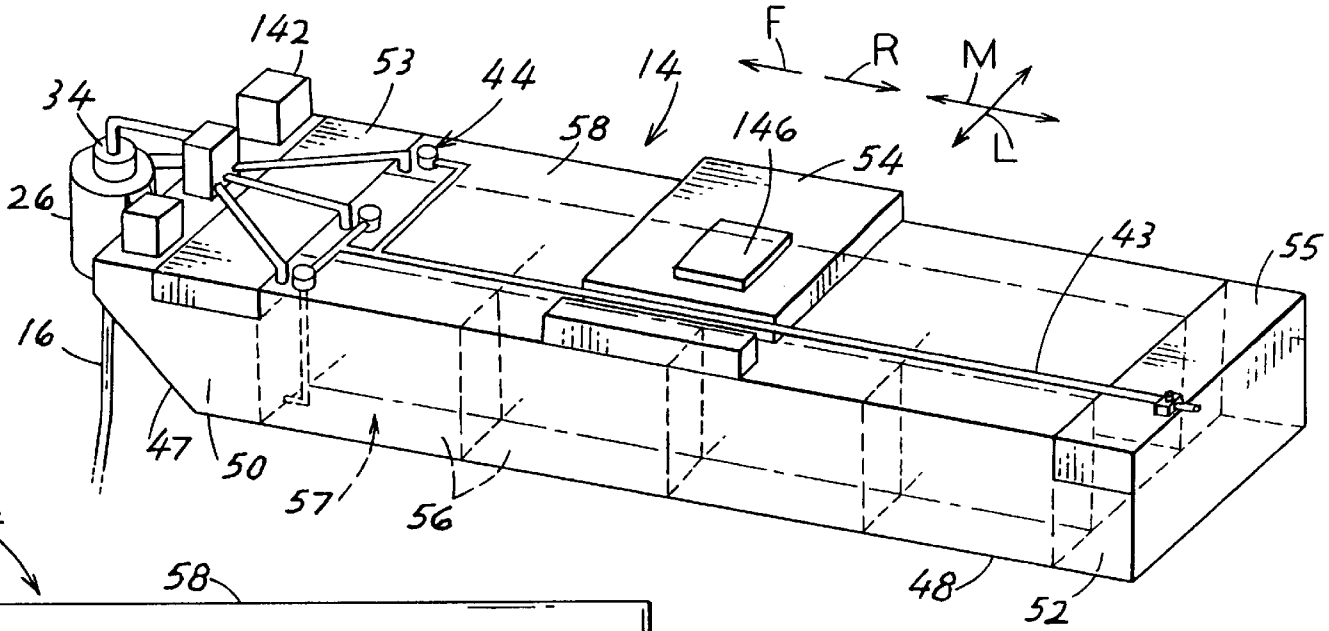
FIG. 2 is an isometric view of the storage barge of FIG. 1.

FIG. 2 shows that the storage barge 14 includes front and rear ends, or bow and stern 47, 48 that are separated along a longitudinal direction M that is perpendicular to a lateral direction L along which the port and starboard are spaced. Bow and stern regions 50, 52 are left empty to provide buoyancy there and to stabilize the vessel. Fixed ballasts lie at 53, 54 and 55. The barge is devoid of an active ballast system, wherein seawater is pumped into or out of ballast tanks as the barge fills with hydrocarbons. Such active systems in prior barges were operated by crew members, using power from generators driven by hydrocarbon-energized engines. Applicant constructs the barge so incoming oil is evenly distributed, so an active ballast system is not necessary during loading.

Figure 7:
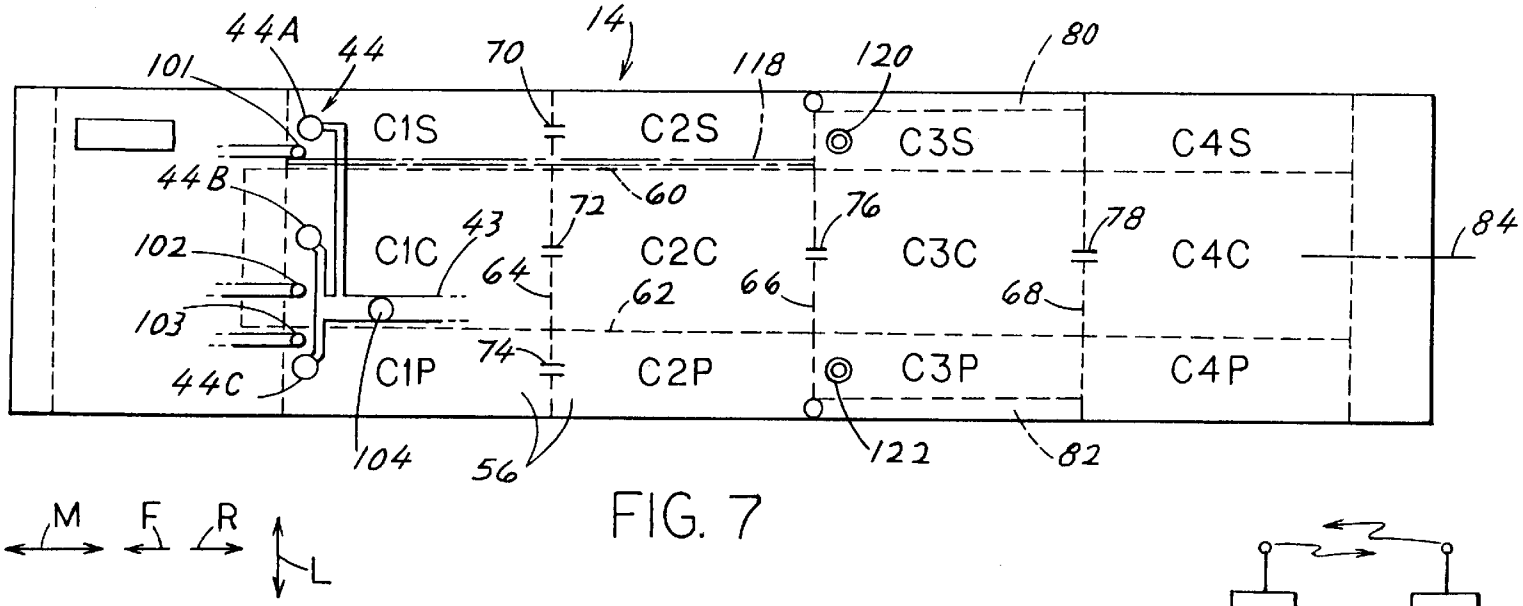
FIG. 7 is a schematic plan view of the barge of FIG. 2, showing the tank and coupling arrangement thereon.

The barge forms a tank assembly 57 divided into twelve cargo tanks 56. In designating the tanks, "S" stands for starboard, "P" for port, and "C" for center. FIG. 7 shows that the twelve cargo tanks are arranged with four starboard cargo tanks labeled C1S, C2S, C3S, and C4S arranged along the starboard side of the barge. Four port tanks labeled C1P, C2P, C3P, and C4P are arranged along the port side of the barge. Four center cargo tanks labeled C1C, C2C, C3C, and C4C are arranged along the middle of the barge. Two bulkheads 60, 62 extending in a longitudinal direction M separate the center tanks from the starboard and port tanks. Three additional bulkheads 64, 66, 68 separate adjacent tanks that lie one behind the other. Short conduits 70, 72, 74 connect adjacent starboard tanks or adjacent center tanks, or adjacent port tanks. Two additional short conduits 76, 78 connect the other center tanks. Long conduits 80, 82 connect the fourth side tanks C4S, C4P to the second side tanks C2S, C2P, bypassing the third side tank C3S and C3P (which are buffer tanks). The barge hull is symmetric on laterally L opposite sides of a center plane 84.

All fluid conduits extending between tanks are provided with two valves for redundancy. Under normal conditions the valves are open and the hydrocarbons can flow freely from one tank to another. In an emergency the valves can be closed by the solar powered control system.

Liquid hydrocarbons from the production facility are flowed into the frontmost tanks C1S, C1C, and C1P, to flow to all tanks behind the front ones, except for the third, or buffer tanks C3S and C3P. Inlet ports 101–103 are shown at the bow end, to which flowlines can be connected to fill the barge tanks.

Figure 6:
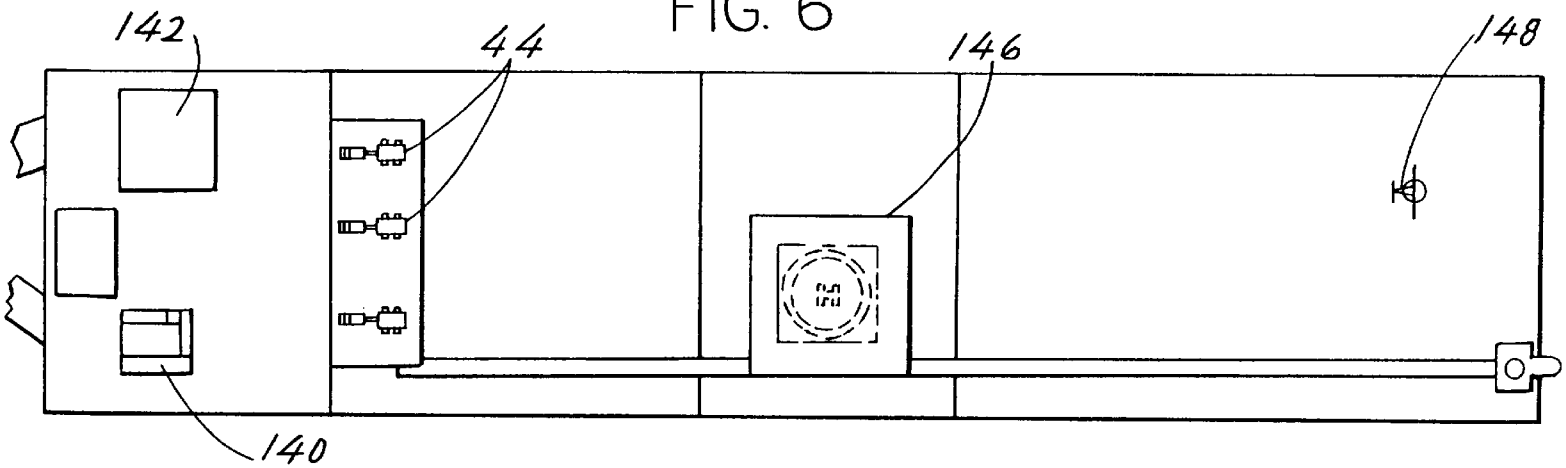
FIG. 6 is a plan view of the barge of FIG. 5.

When a shuttle, or offloading, tanker such as 40 in FIG. 1 is moored close to the storage barge, and the transfer line 42 is connected, the ends of the transfer line at the barge are connected to three pumps shown in FIG. 7 at 44A, 44B, and 44C. Engines at 142 (FIG. 6) in an engine house are started by a temporary crew member. The engines drive a generator whose electrical output energizes motors on the pumps 44. Selected valves are set so the pumps pump out oil from all tanks except for the third side tanks C3S, and C3P which are middle isolated buffer tanks. Oil from the production facility continues to flow to the barge during offloading, but such new oil is diverted, as through bypass pipes 118 (FIG. 7) to continue to fill the tanks C3S and C3P. This allows for a correct metering of the amount of oil that has been pumped from the barge to the tanker, as by a flow meter 104 connected in series with the pipe 43. After all but the third side cargo tanks are empty, and the tanker is disconnected from the barge, oil is pumped via pumps 120, 122 and valves that can be opened and/or energized and closed from the third side tanks C3S and C3P into another tank.

If substantially all liquid hydrocarbons, or oil, in the barge (except in the third side tanks) is to be pumped out to the shuttle tanker, then substantially all of the oil has to be flowed to the pumps 44 that are close to the bow of the barge (except for oil directly pumped out of a rearward tank). Applicant assures that oil will flow towards the bow end through the locations of the pumps 44, by assuring that the barge is tilted, or trimmed by the forward end, i.e. the bottom of the barge is tilted forward and downward.

Figure 3:
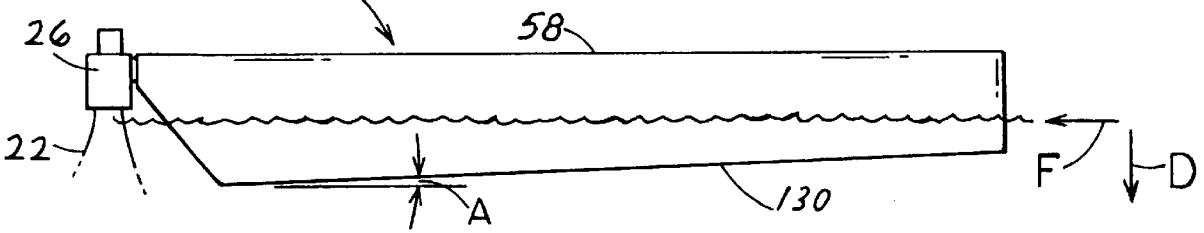
FIG. 3 is a side elevation view of the storage barge of FIG. 2, when it is almost empty.

FIG. 3 shows the bottom 130 of the barge, which is straight and extends at a downward D and forward F incline at an angle A where A is about 2°. The barge 14 automatically assumes this orientation when the barge is substantially empty (under 2% of maximum capacity, except for the third side tanks). The weight of the turret 26 and of chains of the anchor lines 22 weight the bow of the tanker. The distribution, shown in FIG. 2, of the empty spaces at 50 and 52 and the weight of the ballast 53, 54, 55 plus the placing of heavy equipment including engines for energizing the pumps, at the bow of the vessel, all result in the orientation of the barge bottom at 130, at the downward-forward incline. The incline angle is preferably at least 0.5 degrees, but no more than 8 degrees. An incline angle of much less than about 0.5 degrees, results in oil at the bottom of the rearmost tanks moving very slowly or not at all, so that a substantial amount of such oil will not be pumped out to the tanker. An angle of more than 8 degrees can result in a tall bow and a barge that does not efficiently use the steel of its hull to store hydrocarbons, and that is unstable. The deck 58 is horizontal when the barge bottom is inclined at angle A.

Figure 4:
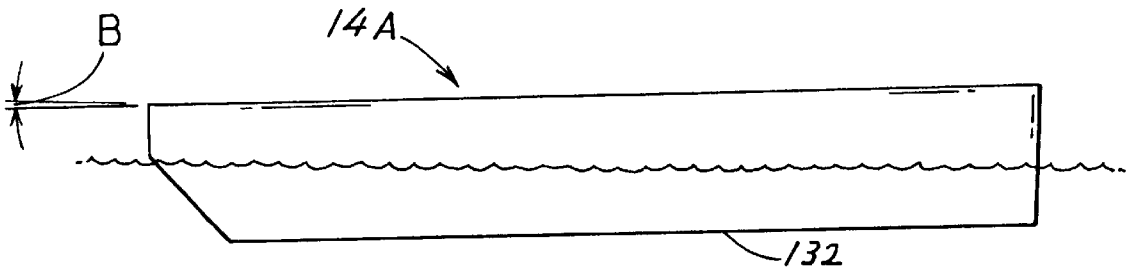
FIG. 4 is a side elevation view of a storage barge of another embodiment of the invention, when it is almost empty.

FIG. 4 shows another barge 14A, where the stern and bow of the barge are of about the same height, but the stern lies higher out of the water than the bow. (both when the barge is full of oil and when it is almost empty). This results in the straight bottom 132 extending at a forward downward incline B of about 2°.

Figure 5:
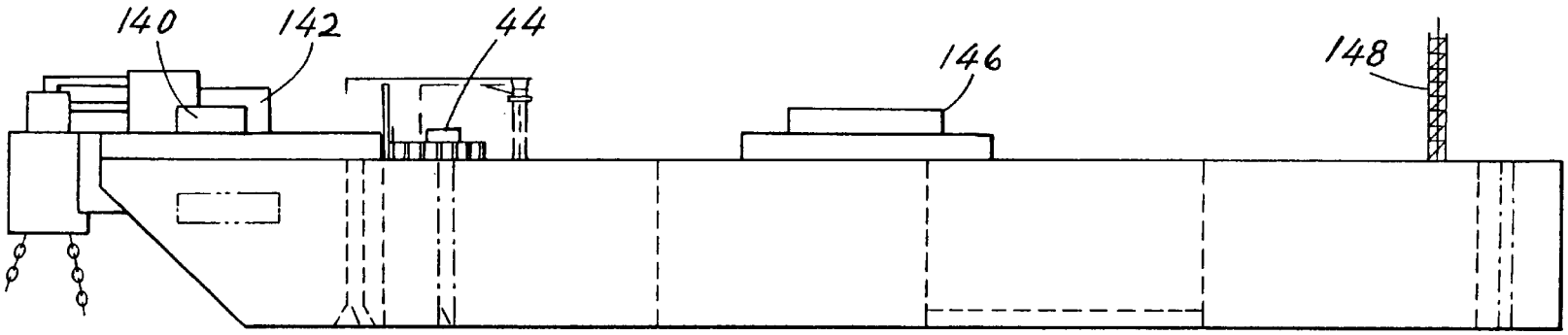
FIG. 5 is a side elevation view of the barge of FIG. 2, showing additional equipment thereon.

FIG. 5 shows some of the equipment on the barge, including an accommodation module 140 for a temporary crew and an engine house 142 that protects the electricity (or hydraulic) generation engines. A helicopter landing pad 146 facilitates access to the barge. An inert gas vent mast 148 vents gas. Only the liquid with fine debris (e.g. sand) is flowed into the storage tanks.

Figure 9:
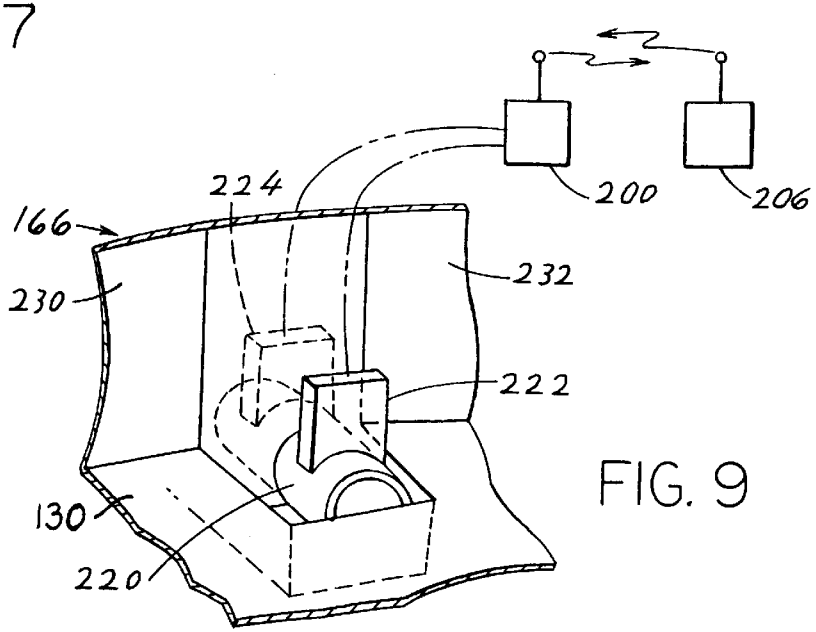
FIG. 9 is a partial isometric view of the fluid connection of FIG. 8.

FIGS. 8 and 9 shows a sump 160 that connects adjacent tanks such as C1P and C2P and that results in projections in the bottom of the hull. The sumps, that include valves, are the short conduits 79–82 shown in FIG. 7. A wall 166 separates the tanks, and a pipe 220 extends through the wall at a level within the sump. A pair of shut-off valves 222, 224 lie along the pipe to shut off the flow. The valves are remotely operated valves, which are well known. The valves 222, 224 can be operated by a person at the remote station 206 through the onboard transceiver 200. For example, if the barge should tilt so the stern moves down more than normal, valves that connect to more forward tanks can be closed to prevent more oil from flowing under the force of gravity into the rearmost, or sternmost, tanks. Only a small mount of oil remains in the sump when the tanks are emptied. FIG. 9 shows that the bulkhead wall 166 has wall portions 230, 232 that converge to direct oil toward the sump as would be seen in a plan view.

The barge does not have propulsion or steering systems. During an unmanned period such as one month, the barge uses no conventional power generation, (i.e. no engine using hydrocarbon fuel). This is the safest solution from a fire aspect, and reduces operating costs. The battery and solar cell assemblies 192 (FIG. 1) on the barge supply energy to the control system, and the telemetry and navigation aids. The barge has an empty space 52 (FIG. 2) at the stern of the vessel, which serves as a crumple zone that takes up shock in the event that a tanker strikes the barge. The lack of tanker propulsion increases the value of the crumple zone.

In a barge that applicant has designed, the barge has an overall length, excluding the turret, of 172 meters, a beam width of 40 meters, and a depth of 20 meters. The draught of the vessel is about 15.5 meters. It is noted that at a 2° tilt, which the barge assumes when nearly empty, the bottom of a bow tank such as C1C, is about 6 meters below the bottom of a stern tank such as C4C.

It is noted that the engine house 142 and temporary crew quarter 140 are located forward of the cargo tanks. This increases safety, because in the event of a cargo fire, smoke and gas is blown rearwardly along the barge, due to the fact that the barge weathervanes itself so its bow is always directed upwind. With the pumps at the bow, the long rigid pipe 43 carries fluid to the rear of the barge to minimize the required length of the hose 42 extending to the offloading tanker.

Thus, the invention provides a hydrocarbon transfer system with a storage barge that is constructed to minimize the cost for barge construction, maintenance and operation. The barge has a tank assembly that includes rows of tanks lying one behind the other, so hydrocarbons can be passed through them in series. The barge is of the type that has a turret at one end that is anchored to the seafloor to allow the barge to weathervane, or is of the type that is spread moored. The barge is devoid of conventional powered (by hydrocarbons) systems that operate during loading, and can be remotely controlled via telemetry and a control system installed on the barge, to enable the barge to operate for long periods without a crew. The barge has a crumple zone at the rear. Produced oil is preferably offloaded from the bow end through pumps, using a rigid pipeline that extends along the length of the vessel, with the rear of the pipe having a coupling for a connection to a hose that leads to an offloading vessel. Middle tanks of the rows of tanks, are separated from the other tanks, and receive produced oil while oil from the other tanks is offloaded, to enable accurate counting of the amount of offloaded oil.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A hydrocarbon storage system (10) for use in a sea to store liquid hydrocarbon, comprising:

a barge (14) that includes a hull (30) with bow and stern ends (47,48), said bow and stern ends of said hull respectively forming front and rear ends of said hull and being longitudinally-spaced, with said hull forming a tank assembly (57);

said tank assembly includes a plurality of rows (C1S, C2S; C1C, C2C; C1P, C2P etc.) of tanks, with the tanks of each row lying one longitudinally behind another and including an end tank at an end of said barge for each of said rows, said tanks having bottom walls (130) and including a plurality of fluid couplings (72, 76, 78) arranged to couple the tanks of each row longitudinally directly in series;

a telemetry link (200) on said barge for receiving radio signals from a remote station not on said barge;

a plurality of said fluid couplings each includes at least one shutoff valve (222, 224) connected to said telemetry link, so the valve can be closed by signals from said remote station.

2. The system described in claim 1 wherein:

said barge includes a passive ballast system (53, 54, 55) which controls orientation of said barge, with said barge being devoid of an active seawater ballast system.

3. The system described in claim 1 wherein said system is designed for use with an offloading tanker (40) that removes hydrocarbon from said barge, and with a hydrocarbon production facility (12) for supplying hydrocarbon to said barge, wherein:

said plurality of rows of tanks includes a middle row and a pair of side rows on opposite sides of said middle row, with each of said rows of tanks having a frontmost tank (C1S, C1C, C1P), and with said rows including a pair of isolated middle side tanks (C3S, C3P) lying at opposite sides of said hull and about halfway between the bow and stern and connected to at least one other tank of said three rows only through means (120,122) that can be opened and closed;

means (118) for filling said isolated middle side tanks with hydrocarbons from said production facility while pumping out hydrocarbons from the other of said tanks to said offloading tanker.

4. A hydrocarbon storage system for storing liquid hydrocarbon, comprising:

a longitudinally elongated barge hull (30) with bow and stern ends and with a tank assembly (57), where said tank assembly includes a plurality of tanks, said tank assembly including a first tank (C1S, C1C, C1P) at a first end of said hull and at least a second tank (C2S, C2C, C2P) lying adjacent to but longitudinally further from said first end of said hull than said first tank, with said first and second tanks having substantially coplanar tank bottom walls (130) and with a fluid coupling (72) that connects said first and second tanks, with said fluid coupling having a fluid coupling bottom lying at about the level of said tank bottom walls;

a pump (44) coupled to said first tank for pumping out liquid hydrocarbon therefrom;

said barge is devoid of an active seawater ballast system, and said barge has an inactive ballast system, that produces a predetermined orientation of said tank bottom walls so they are tilted by an angle (A) of at least 0.5° but no more than 8° from the horizontal when said tanks are empty, with the bottom wall of said first tank being lowermost.

5. The system described in claim 4 wherein:

said hull has a primarily vertical wall (166) separating said first and second tanks, with an opening (160) at the bottom of said primarily vertical walls forming said fluid coupling;

said primarily vertical wall has a pair of wall portions (230,232) on opposite sides of said opening, which converge toward said opening, as viewed in a downwardly-facing view.

6. A method for operating a hydrocarbon production system comprising a hydrocarbon production facility that includes at least one sea floor well, a storage barge that has a tank assembly, and an anchor system that anchors said vessel to the sea floor through a turret to allow said vessel to weathervane, so oil from said well can be stored in said tank assembly and offloaded from a major portion of said tank assembly to a tanker during offload periods spaced at least a week apart, comprising:

transporting a temporary crew to said vessel when said tanker comes to said storage vessel, and using said crew to make connections and operate at least one pump to offload oil in said tank assembly to said tanker, and to later disconnect said connections and stop operations of said pump;

removing said crew from said storage barge and sailing said tanker away from said storage barge, while allowing said storage vessel to remain without a crew for a period of at least a week while oil flows into tank assembly;

allowing a passive ballast system to maintain said barge with said tank bottom walls tilted by 0.5° to 8° from the horizontal when said major portion of said tank assembly is less than 2% full, with a selected one of the bow and stern ends lowermost.

7. A hydrocarbon storage system (10) for use in a sea to store liquid hydrocarbon, comprising:

a barge (14) that includes a hull (30) with bow and stern ends (47, 48), said bow and stern ends of said hull respectively forming front and rear ends of said hull, and being longitudinally-spaced, with said hull forming a tank assembly (57);

said tank assembly includes a plurality of rows (C1S, C2S; C1C, C2C; C1P, C2P, etc.) of tanks, with the tanks of each row lying one longitudinally behind another and including an end tank at an end of said barge for each of said rows, said tanks having bottom walls (130) and including a plurality of fluid couplings (72, 76, 78) arranged to couple the tanks of each row longitudinally directly in series;

a telemetry link (200) on said barge for receiving radio signals from a remote station not on said barge;

a plurality of said fluid couplings that include at least one remotely operable shutoff valve (222, 224).

* * * * *